United States Patent [19]

Perry

[11] 4,265,626

[45] May 5, 1981

[54] TRIMMING DEVICE TO CONTROL PROPELLER FORCES AFFECTING PROPELLER DRIVEN BOATS

[76] Inventor: John C. Perry, 3170 Falcan Dr., Carlsbad, Calif. 92008

[21] Appl. No.: 18,781

[22] Filed: Mar. 8, 1979

[51] Int. Cl.[3] ..... B63H 1/28

[52] U.S. Cl. ..... 440/66; 114/152

[58] Field of Search ..... 114/145 R, 145 A, 146, 114/152, 163; 115/34 R, 17, 18 R, 41 R, 35, 37, 39; 440/51, 66, 71

[56] References Cited

U.S. PATENT DOCUMENTS

| | | | |
|---|---|---|---|
| 1,780,075 | 10/1930 | Griffith | 115/41 |
| 2,370,212 | 2/1945 | Van Gorden | 115/35 |
| 3,976,027 | 8/1976 | Jones | 115/41 |
| 4,096,819 | 6/1978 | Evinrude | 115/17 |

*Primary Examiner*—Trygve M. Blix
*Assistant Examiner*—Jesus D. Sotelo
*Attorney, Agent, or Firm*—Robert G. Upton

[57] ABSTRACT

A trimming wedge is disclosed to trim a propeller driven boat for better performance. The wedge is fixed at its base to the center shaft housing of a propeller driven power boat. The trimming wedge extends approximately the length of one blade of the propeller and is positioned in front of and in line with the propeller blade. The trimming wedge or vane splits the water in front of the propeller so that the blade of the propeller passes through a void in the water. For example, when the wedge is positioned vertically downwardly from the shaft housing, the void occurs when the clockwise arc of the blade is in about the downward four o'clock to eight o'clock position when viewed from the rear. A trimming wedge with the proper wedge angle neutralizes the tendency of the propeller to "walk" the boat sideways or to the right with a clockwise turning propeller, thus transferring the side load thrust to forward thrust when the boat is propelled through the water, resulting in an increase in forward speed.

9 Claims, 14 Drawing Figures

TRIMMING DEVICE TO CONTROL PROPELLER FORCES AFFECTING PROPELLER DRIVEN BOATS

BACKGROUND OF THE INVENTION

1. Field of the Invention

This invention relates to a means to improve the performance of a propeller driven power boat.

More particularly, this invention relates to a method and means to neutralize the undesirable propeller forces, such as side thrust loads, thereby trimming the boat to obtain better performance.

2. Description of the Prior Art

Propeller driven power boats of all kinds are disadvantaged in that they all produce a certain amount of non-productive thrust loads when the propeller is driven through the water.

This phenomenon is explained by the following example. When the propeller is turning in a clockwise direction (the propeller may turn in either direction) with a blade of the propeller passing through about the four o'clock position to about the eight o'clock position, it generates side thrust loads that tend to push the stern of the boat to the right. In other words, the rotation of the blade from about the four o'clock to the eight o'clock position causes the stern of the boat to yaw to the right, turning the bow of the boat to the left; hence, the helmsman must correct to the right to compensate for the yaw condition of the boat. The rotation of the lower propeller blade encounters water that is more dense because it is at a greater depth than the water encountered by the upper blade during its' rotation, thus it drives the stern to the right due to the greater resistance offered by the more dense, deeper water.

In high speed racing boats, such as a deep V or a hydroplane, where tremendous horsepower is transmitted to the propeller, the undesirable side producing loads are even more pronounced. The constant rudder correction to compensate for the yaw producing tendency of the propeller produces a drag condition that slows down the boat. Aside from the increased drag, the boat is extremely difficult to hold on a course which obviously is both dangerous and fatiguing to the driver of the boat.

Where counter rotating twin propellers are utilized in some boats, the yaw producing side loads are cancelled out, one against the other. However, these loads still exist which tend to pull the propeller shafts together or to push them apart (depending on their rotation) and thus collectively subtract from the forward producing thrust of each propeller in the twin screw arrangement.

The present invention substantially converts the undesirable propeller loads, such as side producing thrust of a boat's propeller to forward thrust, resulting in an increase of boat performance without increasing the horsepower level of the propulsion unit.

SUMMARY OF THE INVENTION

It is an object of this invention to improve the thrust efficiency of a propeller driven power boat.

More particularly, it is an object of this invention to provide a trimming wedge or vane upstream and in line with a propeller blade to substantially neutralize the undesirable propeller forces that affect the trim of the boat, such as the tendency of the propeller to "walk" the stern of the boat sideways.

A flow control device is disclosed for a power boat having at least one propeller wherein at least one of the devices control the direction of the propeller forces propelling the boat through the water.

The device consists of at least one trim wedge positioned upstream of the at least one propeller, the wedge having a first base end secured to the boat substantially in line with at least one blade of the propeller. The wedge is cantilevered from the secured first end, a second end of the wedge terminates substantially adjacent the tip of the blade of the propeller. The wedge wide trailing edge divides the water creating a void air space through a section of the 360° track of the propeller. As a blade of the propeller rotates through the void its driving force is obviated while within the void space, thus substantially removing any undesirable propeller driving force affecting the boat as the boat is propelled through the water.

The wedge, or vane trim device, converts the side or yaw producing loads induced as the propeller is driven through the water to forward thrust producing loads. The wedge is positioned upstream of the propeller having a first end that is secured to the boat near the center line of the propeller, the wedge is cantilevered from the secured first end. The wedge is positioned downwardly and substantially normal to the bottom of the boat, the second end of the wedge terminates substantially adjacent the tip of a blade of the propeller. The wedge having a fairly wide, blunt trailing edge divides the water, creating a void, where a blade of the propeller rotates through its side producing arc in the lower stroke of the blade, thereby substantially neutralizing the yaw inducing tendency of the propeller, transferring the side force to forward producing thrust.

An advantage over conventional propeller driven boats is the control of the direction of propeller forces which adversely affect the performance of the boat.

A particular advantage is the substantial elimination of the side inducing force by partially neutralizing the force of the lower propeller blade as the boat is propelled through the water.

Yet another advantage of the invention over conventional propeller driven boats is the conversion of the undesirable propeller force loads to forward inducing thrust by increasing the propeller blade pitch to take advantage of peak horsepower, thus increasing the speed of the boat without an increase in engine horsepower.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DESCRIPTION OF THE PREFERRED EMBODIMENTS AND BEST MODE FOR CARRYING OUT THE INVENTION

Figure 1:
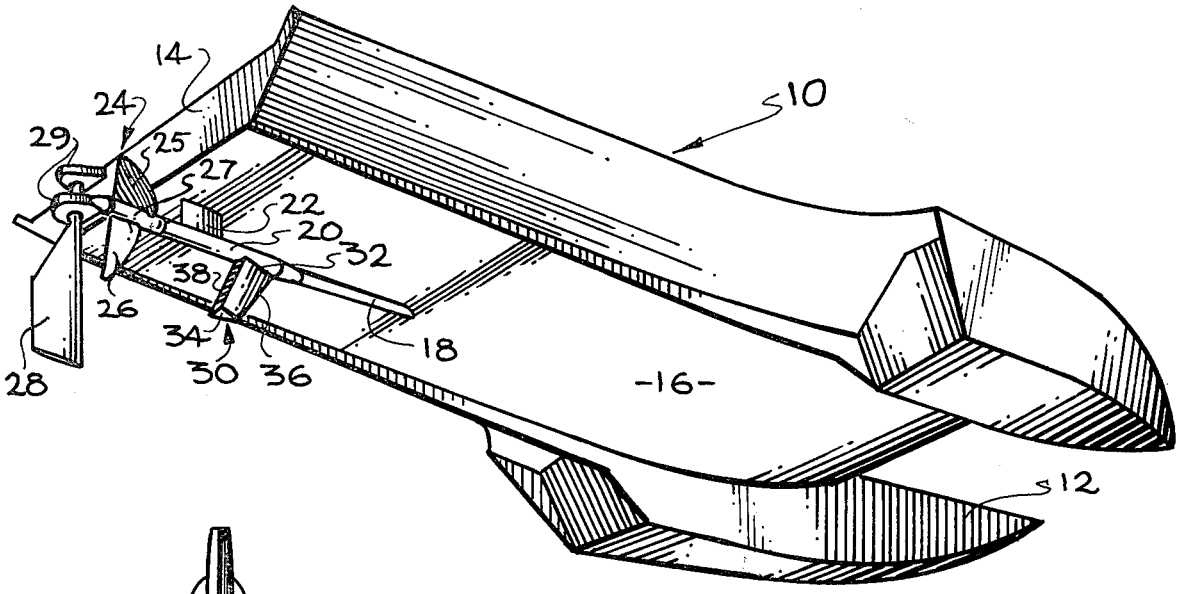
FIG. 1 is a perspective view of a hydroplane propeller driven power boat illustrating the trimming wedge connected to the propeller shaft housing forward of the propeller blade.

Referring to FIG. 1, the hydroplane boat, generally designated as 10, consists of a bow section 12, a stern 14 and a bottom 16. A propeller shaft 18 extends through bottom 16 and terminates adjacent a propeller, generally designated as 24. The propeller shaft 18 extends through a propeller shaft housing 20 which is affixed to a shaft housing support strut 22 that is attached to the bottom 16 of the hydroplane 10. The propeller 24 comprises propeller blades 25 and 26 which are attached to propeller hub 27. A rudder 28 is supported by rudder support pivots 29 connected to the stern 14 of the boat 10.

Attached to the propeller shaft housing 20 is a trim wedge or vane, generally designated as 30. The wedge is attached at its base 32 to housing 20. The tip 34 of the wedge 30 extends approximately the distance of the propeller blades 25 and 26. The reason for the trim wedge extending from the propeller shaft housing 20 will be explained in greater detail later on in the specification.

Figure 2:
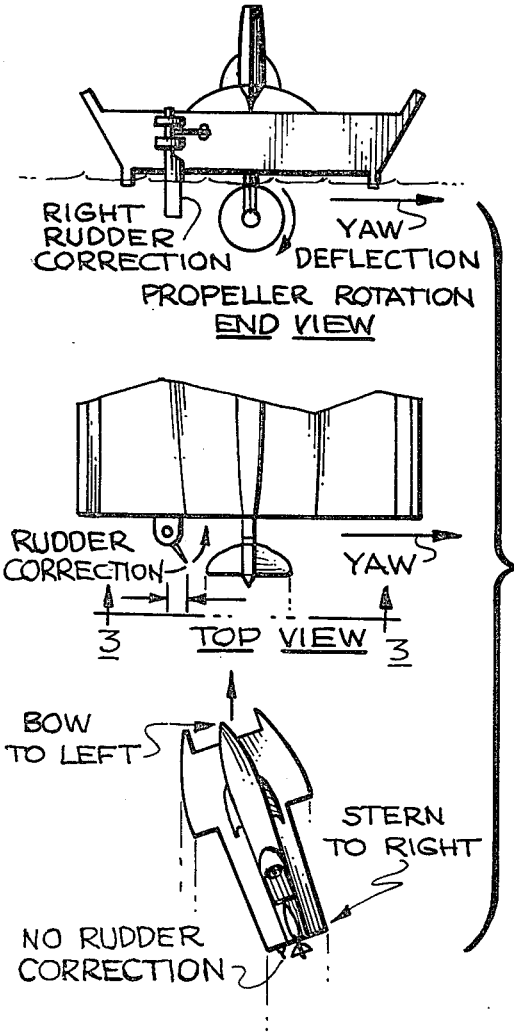
Fig. 2 PRIOR ART
FIG. 2 consists of a series of illustrations of the prior art showing the yaw deflection phenomenon created by the boat propeller.
Figure 3:
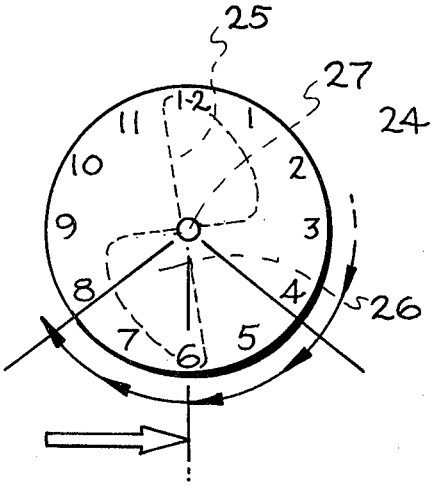
FIG. 3 is a view taken through 3—3 of the prior art illustrating the boat propeller in dotted line superimposed on the face of a clock so that the undesirable propeller force loads, such as the side thrust producing phenomenon, may be explained with relation to the numbers on the clock face.

The several views of the prior art illustrated in FIG. 2 depict a conventional hydroplane boat as it is being propelled through the water. The end view illustrates the hydroplane with its propeller rotating in a clockwise direction. As the bottom blade of the propeller passes through the four o'clock to about the eight o'clock position (FIG. 3), the blade pushes against the more dense, deeper water which in turn forces the stern of the boat towards the right. With reference to FIG. 3, the blade 26, as it traverses from the four o'clock to the eight o'clock position, is pushing against solid, heavier, more dense water while the upper blade 25 is passing through lighter, less dense water. Therefore, it follows that the bottom blade 26, passing through more dense water through the six o'clock position, will force the stern of the boat to the right. To compensate, as seen from the middle top view and the bottom view, the rudder must be deflected toward the right to force the bow of the hydroplane, which is trying to swing to the left, toward the right, to compensate for the yaw deflection created by the propeller churning through the water. Both the boat yaw deflection and the rudder deflection to compensate for the boat yaw deflection, creates drag as the hydroplane is raced across the water. In addition to the induced drag caused by the deflected rudder, the boat may be riding bow high or low in an out of trim condition. All these forces can be controlled to trim the boat for maximum boat performance by selective placement on the drive shaft housing 20 of one or more boat trim wedges or vanes 30 with the proper triangular wedge angle around and in front of the propeller 24. As heretofore mentioned, the hydroplane is slowed by the propeller force deflections and the attendant rudder and trim corrections which cause the boat to go slower while fatiguing the driver of the boat which is undesirable as well as being dangerous. Obviously, too much wedge angle will cause the stern to move to the left when the propeller is rotating clockwise and too little angle will not correct the undesirable propeller forces completely.

Figure 4:
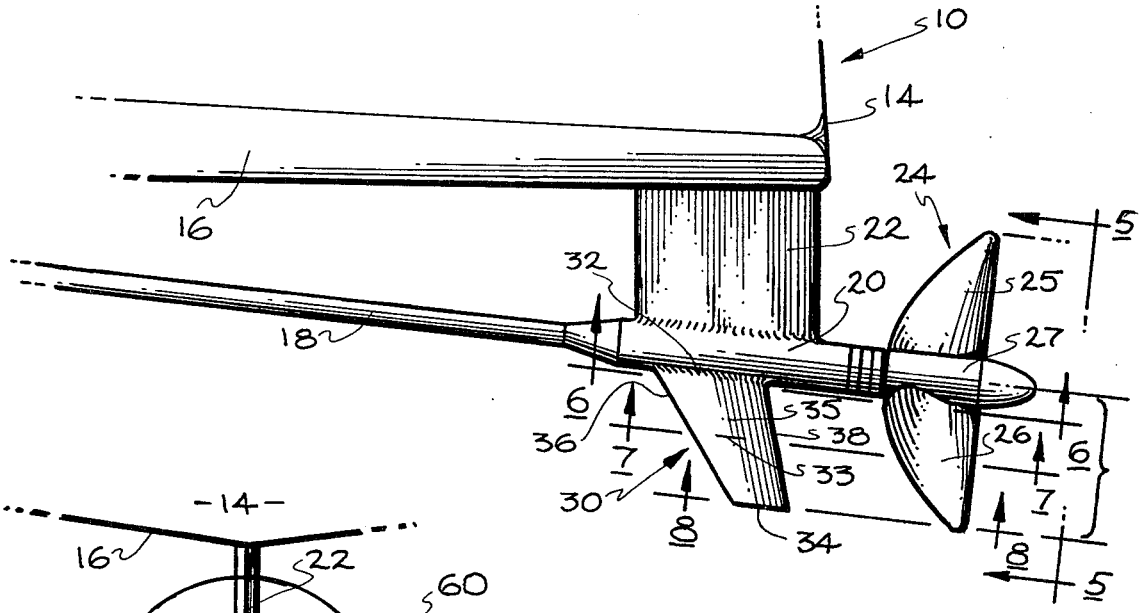
FIG. 4 is a partial side view of the stern of a propeller driven boat illustrating the propeller, drive shaft housing and the trimming wedge connected to the base of the housing.
Figure 5:
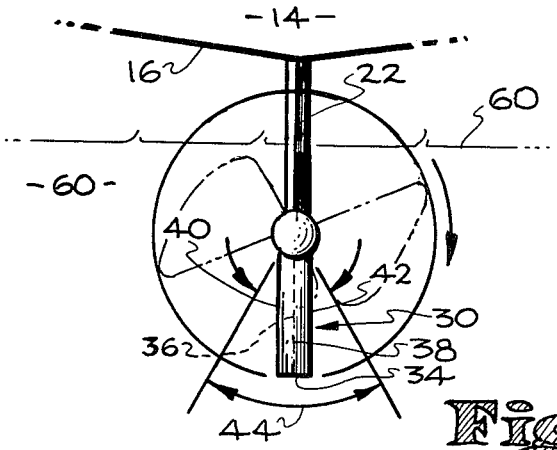
FIG. 5 is a view taken through 5—5 of FIG. 4 illustrating the shape of the void created by the trimming wedge attached to the propeller shaft housing.
Figures 6, 7, 8:
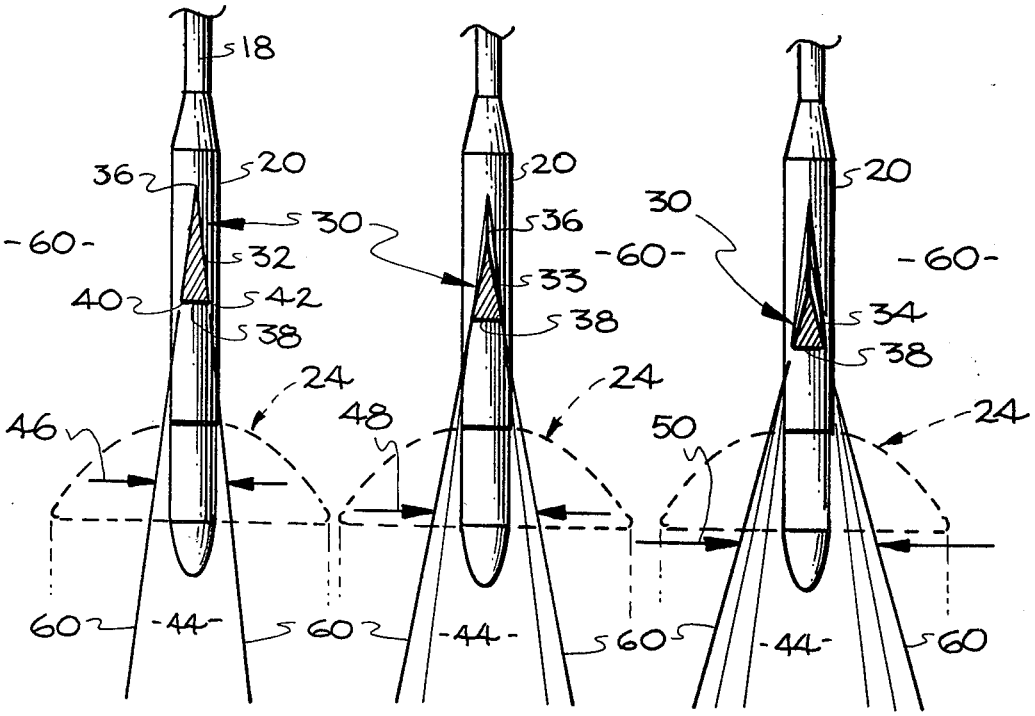
FIG. 6 is a view taken through 6—6 of FIG. 4 illustrating the shape of the void trailing behind the trimming wedge through that particular section of the trim wedge.
FIG. 7 is a view taken through 7—7 of FIG. 4 illustrating the shape of the void trailing behind the trimming wedge taken through the middle of the trim wedge.
FIG. 8 is a view taken through 8—8 of FIG. 4 illustrating the shape of the void at the tip of the trim wedge.

Referring now to FIG. 4, the partial side view illustrates the stern of the boat 14 with the shaft 18 extending from the bottom 16 of the boat transitioning into the propeller shaft housing 20 which is affixed to the bottom 16 of the boat by strut 22. The shaft terminates in a propeller 24 having blades 25 and 26 attached to hub 27 of the propeller. Trim wedge 30 is attached at its base 32 to housing 20 by, for example, metallurgically bonding the trim vane to the shaft housing 20. The leading edge 36 of the trim wedge 30 converges toward the trailing edge 38 of the wedge toward tip end 34. Thus, the base 32 is wider than the tip 34 of the wedge 30. With reference to FIG. 5, it can be seen that the trailing edge 38 forms parallel lines or edges 40 and 42. The trim wedge has a leading edge which is very sharp that extends from base 32 to tip 34 in a single line. The resultant triangular wedge shape can be seen in FIGS. 6, 7 and 8. The shape of the triangular wedge of the trim vane 30 determines the shape of the void 44 as seen in FIG. 5. As illustrated, the void starts at the base 32 of trim wedge 30, the edges of the void being close to hub 20 of propeller shaft 18 and widens out into a pie-shaped form toward the tip 34 of wedge 30. FIG. 6 clearly depicts the triangular wedge shape taken through 6—6 of FIG. 4 through base 32 of wedge 30. It is shown that the triangular wedge is relatively long a base 32 which results in a narrow void 44 nearest the base 32 of wedge 30. Thus the roots of the propeller blades 25 and 26 pass through a narrow gap 46 near the hub 27. With reference to FIG. 7, the triangular wedge is more blunt through the center of the trim vane 30 and the air space 44 is much wider (48). The blades 25 and 26, as they are passing through the six o'clock position (FIG. 3), pass through a wider space of air thus rendering the blade ineffective in this zone. FIG. 8 illustrates a much blunter triangular wedge taken through the tip 34, thus providing an even wider air space 44 as seen through section 50. Thus it can be seen that where the propeller is most effective in causing, for example, the yaw deflection, an air space is created by the trim wedge 30 and its special shape from a very sharp, narrow triangular wedge at its base 32 to a very short, blunter triangular wedge at its end 34 causes the pie-shaped void, as seen in FIG. 5. FIGS. 6, 7 and 8 illustrate the changing angle of the void space 44 as the trim vane wedge transitions from a sharp triangular wedge at its base 32 to a blunter triangular wedge at its tip 34. The propeller then is caused to speed up in RPM through this pie-shaped air space. All engines, particularly racing engines, produce their maximum horsepower output at a particular RPM. An overrevving engine caused by the trim wedge may be corrected by selecting a propeller of increased pitch, thus allowing the engine to maintain peak horsepower with the same number of RPM's. This in turn will increase the boat speed, provided all other parameters remain the same. The boat 10 then will pick up in speed as the yaw deflection phenomenon is neutralized by creating the air space where the propeller passes through about the six o'clock position. The pitch of the propeller must be increased to take advantage of the effects created by the trim vane 30 extending from the housing 20 of the shaft 18.

Obviously this boat trimming wedge could be used on twin propeller arrangements even if the propeller blades are rotating in a clockwise and counterclockwise configuration, one propeller adjacent the other propeller. The two counter-rotating propellers have the following effect. Depending upon which direction each propeller is turning, without trim wedges heretofore described the propeller shaft housings will either try to move toward each other or pull away from each other due to the side producing thrust of the counter-rotating propellers as each propeller passes through about the six o'clock position. If one or more trim wedges with the proper wedge angle is utilized on each propeller, the undesirable deflection tendencies of each of the propellers will be neutralized, thereby causing the watercraft to pass through the water at a faster rate.

Figure 9:
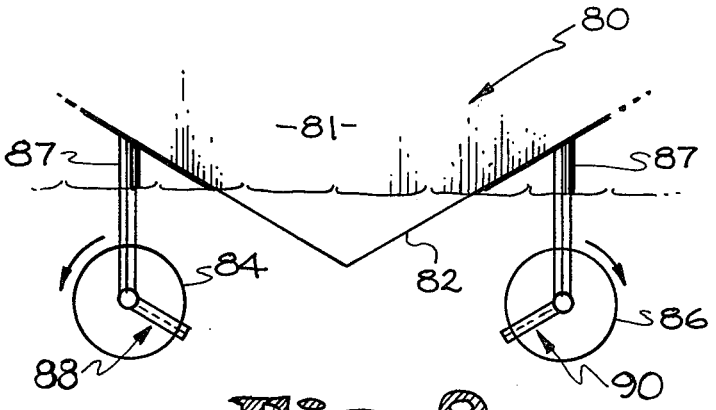
FIG. 9 is a partial rear view of a twin screw boat with counter-rotating propellers with trim wedges cantilevered from each shaft housing.

With reference to FIG. 9, a twin screw boat, generally designated as 80, has attached to its bottom 82 a pair of counter-rotating propellers 84 and 86 suspended from support struts 87. A pair of trim wedges 88 and 90 are cantilevered from the propeller shaft housings (not shown), each trim vane being at an angle roughly parallel with the "V" bottom of the boat 80. The effect of wedge 90 would be to allow the stern 81 to move up and also to neutralize the propeller forces from driving the stern to the right. The effect of trim wedge 88 will also allow the stern to move up. The propeller forces tend to pull the propeller shaft to the left without the wedge. The position of the trim wedge 88 will neutralize this tendency.

Figure 10:
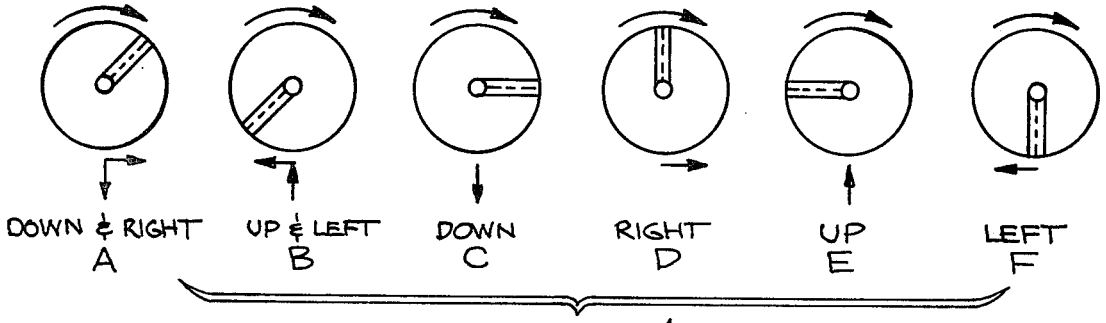
FIG. 10 is a schematic rear view of several rotating propellers with trim wedge vanes in various positions to indicate the result of each wedge position.

The several schematic views of FIG. 10 pictorially describe the effect of the boat trim wedge on a watercraft where the propeller rotation is clockwise. For example, in FIG. A, the position of the wedge on the shaft housing of the rotating propeller will force the stern of the boat to come down lower in the water and cause the stern of the boat to move to the right. In FIG. C, the propeller is rendered ineffective in the three o'clock position thus allowing the stern of a boat to move down in the water. It can be readily realized then that the addition of drag producing trim plates mounted to the stern near the water line normally connected to conventional propeller driven boats may be eliminated by intelligent use of the trim wedges described and taught in the present invention. The boat may be trimmed without trim plates, resulting in a cleaner boat hull configuration as well as a faster, better performing watercraft.

Figure 11:
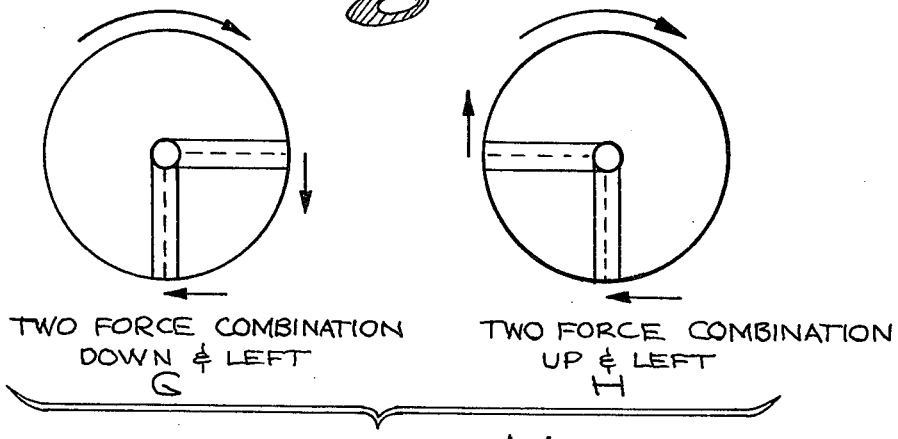
FIG. 11 illustrates two schematic examples of a pair of flow trim wedges positioned on a propeller housing and their effect on the boat.

FIG. 11, G and H, illustrate the effect of a pair of wedges mounted to each shaft housing. For example, in illustration G, the position of the vertical wedge of the pair of trim wedges cancels out the adverse propeller force that tends to push the stern to the right and the remaining horizontal wedge allows the stern to come down in the water when the propeller is rotating clockwise. In illustration H, the vertical wedge neutralizes the right stern propeller force and the horizontal wedge allows the stern to move up in the water with a clockwise turning propeller. The opposite effect would, of course, occur where a propeller is turning in a counterclockwise direction.

Figure 12:
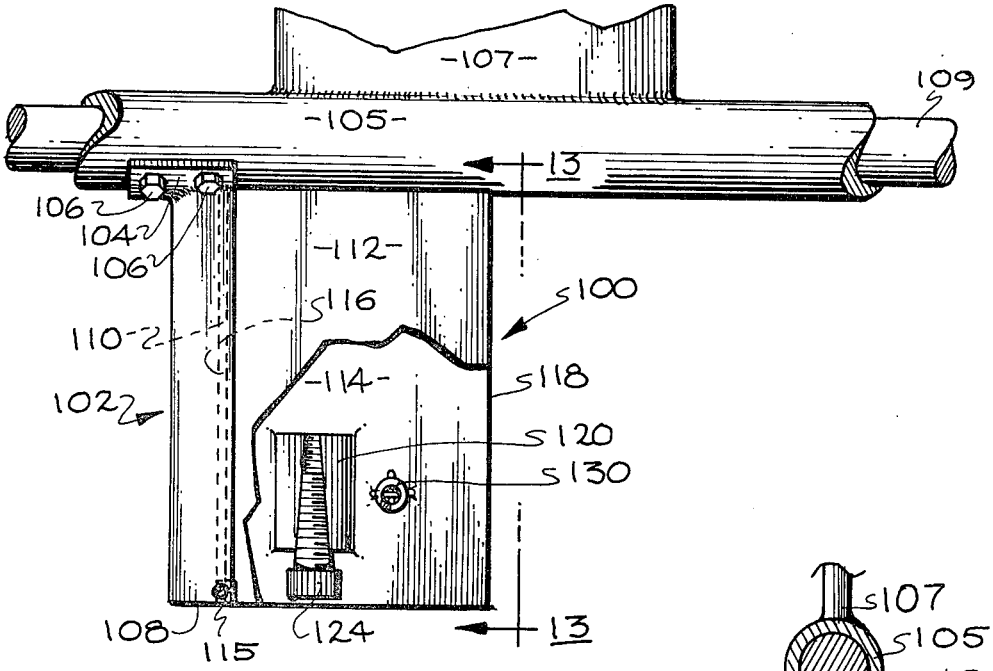
FIG. 12 is a partially cutaway view of an adjustable trim wedge.
Figure 13:
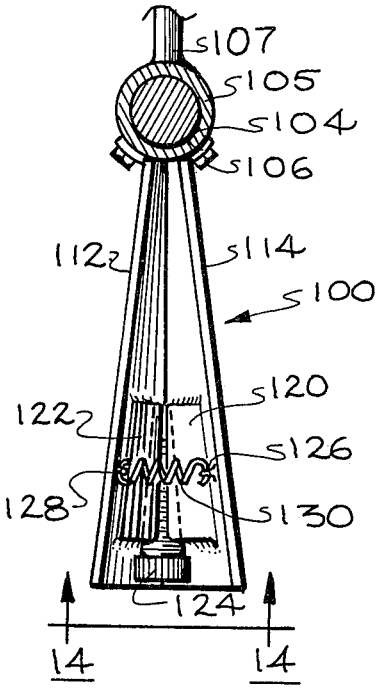
FIG. 13 is an end view taken through 13—13 of FIG. 12.
Figure 14:
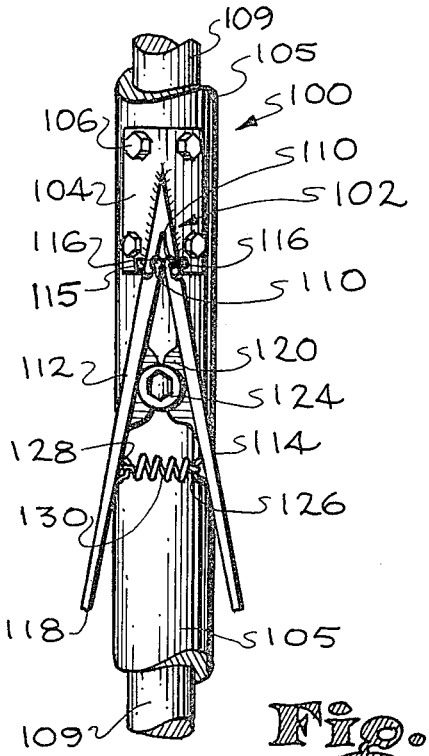
FIG. 14 is a bottom view taken through 14—14 of FIG. 13.

Turning now to FIGS. 12, 13 and 14, an alternative embodiment is illustrated wherein the trim wedge, generally designated as 100, is adjustable in wedge angle and rectangular in shape. The wedge consists of a pair of adjustable wedge panels 112 and 114 hinged to a fixed elongated wedge shaped leading edge, generally designated as 102. The leading edge is attached at its base 104 to the propeller shaft housing 105 by, for example, four bolts 106 threaded into the shaft housing 105. The housing 105, of course, provides a bearing surface for propeller shaft 109; housing 105 being supported by strut 107. The leading edge defines port and starboard half round female type hinge tracks 110 interiorly of leading edge 102 (FIG. 14). Half round male hinge pins 116 are aligned with the hinge grooves 110 at tip 108 of leading edge 102 and subsequently engaged with the groove. A panel retainer stop pin 115 secures the panels within the groove 116. Panel adjustment block 120 and 122 are formed in or are attached to the inside surface of each panel. Tapered threads are formed in each block 120 and 122. A tapered allen type adjustment screw 124 is threaded into the blocks 120-122. The screw is retained within the blocks 120-122 by a spring 130 stretched between spring retainer 128 in panel 112 and retainer 126 in panel 114.

The panels are adjusted to create a larger or smaller void space in the area of the propeller by turning the tapered screw 124 in or out. The boat then may be precisely trimmed through a series of screw adjustments to "fine tune" the trim of the propeller driven watercraft.

It would be obvious to use the trim wedge as taught in this invention even on an outboard boat engine (not shown). To illustrate, the skeg that extends from the propeller shaft housing in front of the propeller of an outboard motor could be a trim wedge which is wide at its trailing edge and has a sharp leading edge with a varying wall configuration from a narrow wedge at its base to a very blunt wedge at its tip, thus splitting the water causing an airspace in front of the outboard motor propeller.

The trim wedge may be rectangular in shape, with a sharp leading edge and a blunt trailing edge (not shown); a short side being attached to the propeller shaft housing at one end, the other end being adjacent the tip of the propeller blades. The trim device in fact could be a cylindrically shaped rod, or almost any shaped rod, cantilevered from the boat bottom, as long as it has the capability to separate the water, creating a void space in the vicinity of the propeller. In addition, the trim wedge could be designed to be extended, retracted or repositioned at any angle by manipulation from the interior or exterior of the watercraft (not shown). The preferred embodiment, of course, being the trim wedge as described in FIGS. 4 through 8.

The trim wedge of the instant invention could be utilized by ocean-going cargo vessels, such as huge oil tankers, with the same effect as described heretofore.

Any watercraft, as long as it is propeller driven, could take advantage of the present invention.

It will, of course, be realized that various modifications can be made in the design and operation of the present invention without departing from the spirit thereof. Thus, while the principal preferred construction and mode of operation of the invention have been explained and what is now considered to represent its best embodiment has been illustrated and described, it should be understood that within the scope of the appended claims the invention may be practiced otherwise than as specifically illustrated and described.

I claim:

1. A boat trim device for a power boat having at least one propeller wherein at least one of said devices controls the direction of the propeller forces propelling said boat through the water comprising:

at least one substantially rectangular trim wedge device positioned upstream of said at least one propeller, said trim device having a first base end secured to said boat substantially in line with at least one blade of said propeller, said trim device being cantilevered from said secured first base end, a second tip end of trim device terminating substantially adjacent the tip of said blade of said propeller, said substantially rectangular trim wedge forms a sharp upstream leading edge from the first base end to the second tip end of said trim wedge, the downstream trailing edge being blunt, said trim wedge substantially forming a wedge shaped triangle when viewed in cross-section, said device serves to split said water creating a void air space through a section of a 360° track of said propeller, as a blade of said propeller rotates through said void, its driving force is substantially obviated while within said void space, thus substantially removing any undesirable propeller driving force affecting said boat as said boat is propelled through said water.

2. The invention as set forth in claim 1 wherein said wedge shaped boat trim device tapers from a wide leading edge to trailing edge base portion to a narrow leading edge to trailing edge tip portion, said wedge forming a blunt, wide trailing edge with separated substantially parallel corners from said first base end to said second tip end of said trim wedge thereby forming a sharp, narrow, pointed wedge through a cross-section through said first base end and a blunt, pointed wedge through a cross-section through said second tip end, said tapered wedge thus creating a pie-shaped void in said water downstream of said trim wedge when viewed through the 360° arc of said propeller thereby separating the water narrowly near a hub of said propeller and widely nearest a tip of said blade of said propeller, the widest void then intercepting that portion of the blade that provides the strongest driving force in the water.

3. The invention as set forth in claim 2 wherein said wide base portion at said first base end of said trim wedge is secured to a shaft housing upstream of said propeller.

4. The invention as set forth in claim 3 wherein said wedge shaped boat trim wedge is positioned downwardly and substantially normal to the bottom of said boat in about the six o'clock position, said trim wedge creates a void in said water which substantially neutralizes the side producing force of the propeller when a blade of said propeller passes through the six o'clock position in the lower portion of the propeller blade rotation, the shape and wedge angle formed by said trim wedge determines the amount of void spaced desired to equalize the top and bottom propeller blade forces thereby removing said side thrust force.

5. The invention as set forth in claim 4 wherein said wedge shaped boat trim device is positioned substantially parallel with respect to the bottom of said boat and to the right or left in about the three or nine o'clock position of said shaft housing when viewed from the rear, said trim wedge creates a void in said water which renders the propeller blade ineffective in the void area thereby allowing the propeller blade force on the opposite side of said void to lift or depress the stern of said boat.

6. The invention as set forth in claim 5 wherein said wedge shaped boat trim device is positioned substantially forty-five degrees with respect to the bottom of the boat, in about the four-thirty or seven-thirty clock position, and to the right or left of said shaft housing when viewed from the rear, said wedge creates a void in said water which renders the propeller blade ineffective in the void area thereby allowing the propeller blade force outside of said void to move the stern of said boat down and left or up and right when said propeller rotates in the clockwise or counterclockwise direction.

7. The invention as set forth in claim 6 further comprising a pair of wedge shaped boat trim devices mounted to said propeller shaft housing, a first wedge mounted substantially normal to the bottom of said boat, a second wedge mounted substantially parallel with the bottom of said boat, said second wedge being positioned to the right or to the left of said shaft, said pair of wedges creates voids in said water which renders said propeller blade ineffective in said void areas thereby allowing the propeller blade force outside of said void areas to equalize said side producing force and to move said stern up or down when said propeller rotates in the clockwise or counterclockwise direction.

8. The invention as set forth in claim 1 wherein said trim wedge device comprises a wedge shaped leading edge support cantilevered from and fixed to a propeller shaft housing, port and starboard trim plates extending from a trailing edge of said fixed leading edge support, said port and starboard plates forming an extension of said wedge shaped leading edge support from upstream trim plate leading edges to widely separated downstream trim plate trailing edges of said port and starboard trim plates forming said blunt downstream trailing edge of said trim wedge device, said trim plates being hinged to said fixed leading edge support along said trim plate leading edges and oriented in hinge slots formed by said fixed leading edge from a first base end to a second tip end of said cantilevered fixed leading edge support, said hinged trim plates having adjustment means to vary the wedge angle of said trim device by pushing apart or pulling together said port and starboard trim plates to create a relatively large or small void area adjacent said blade of said propeller of said propeller driven power boat.

9. A method of controlling the direction of the forces developed by one or more rotating propellers of a propeller driven boat comprising the step of:

attaching one or more wedge shaped void producing means having a sharp upstream leading edge and a blunt downstream trailing edge adjacent one or more propeller drive shaft housings upstream of said one or more propellers in various positions around a clock face normal to said drive shaft housings to cause the rotating force producing propellers to lift, depress or move the stern of said boat to the left or right of any combination of these forces when a blade of said one or more propellers passes through said void created by said one or more void producing means.

* * * * *